US007556243B2

(12) United States Patent
Williams

(10) Patent No.: US 7,556,243 B2
(45) Date of Patent: Jul. 7, 2009

(54) HIGH TENSION CABLE TO METAL BEAM GUIDE FENCE TRANSITION

(75) Inventor: John P. Williams, 2411 Kirby Rd., Rowlett, TX (US) 75088

(73) Assignee: John P. Williams, Rowlett, TX (US)

( * ) Notice: Subject to any disclaimer, the term of this patent is extended or adjusted under 35 U.S.C. 154(b) by 0 days.

(21) Appl. No.: 11/381,155

(22) Filed: May 2, 2006

(65) Prior Publication Data

US 2006/0243954 A1 Nov. 2, 2006

Related U.S. Application Data

(60) Provisional application No. 60/676,926, filed on May 2, 2005, provisional application No. 60/718,886, filed on Nov. 17, 2005.

(51) Int. Cl.
*E01F 15/06* (2006.01)
*E01F 15/00* (2006.01)

(52) U.S. Cl. ..... 256/13.1; 256/12.5; 256/65.01; 404/6

(58) Field of Classification Search ..... 403/1, 403/13.1; 404/6, 11
See application file for complete search history.

(56) References Cited

U.S. PATENT DOCUMENTS 4,607,824 A * 8/1986 Krage et al. ..... 256/13.1
4,678,166 A * 7/1987 Bronstad et al. ..... 256/13.1
4,815,565 A * 3/1989 Sicking et al. ..... 404/6
4,909,661 A * 3/1990 Ivey ..... 256/13.1
4,928,928 A * 5/1990 Buth et al. ..... 256/13.1
5,011,326 A * 4/1991 Carney, III ..... 404/6
5,022,782 A * 6/1991 Gertz et al. ..... 256/13.1
5,039,066 A * 8/1991 Stacey ..... 256/13.1
5,547,310 A * 8/1996 Muller ..... 256/13.1
6,022,003 A * 2/2000 Sicking et al. ..... 256/13.1
6,719,483 B1 * 4/2004 Welandsson ..... 256/13.1
6,848,857 B1 * 2/2005 McColl et al. ..... 404/6
7,249,908 B2 * 7/2007 Bergendahl et al. ..... 256/13.1
2002/0109131 A1 * 8/2002 Smith et al. ..... 256/13.1

OTHER PUBLICATIONS

Letter dated Jun. 8, 2004, from U.S. Department of Transportation, Federal Highway Administration, in Reply Refer to: HSA-10, 7 pages.*

(Continued)

*Primary Examiner*—Daniel P Stodola
*Assistant Examiner*—Ernesto Garcia
(74) *Attorney, Agent, or Firm*—James W. Huffman

(57) ABSTRACT

An apparatus for preventing a collision between a vehicle and an end of a Metal Beam Guide Fence. A transition device is attached to a modified section of the Metal Beam Guide Fence. The transition device and modified section are configured to allow passage of cables of a High Tension Cable Barrier through the Metal Beam Guide Fence and the transition device. The High Tension Cable Barrier redirects the colliding vehicle away from the end of the Metal Beam Guide Fence. The transition device and modified section are also configured to interact with the cables of the High Tension Cable Barrier to transfer and spread the collision load from the high tension cables to the Metal Beam Guide Fence.

7 Claims, 4 Drawing Sheets

OTHER PUBLICATIONS

Letter dated Oct. 4, 2005, from U.S. Department of Transportation, Federal Highway Administration, in Reply Refer to: HSA-10, 3 pages.*

Letter dated Oct. 19, 2005, from U.S. Department of Transportation, Federal Highway Administration, in Reply Refer to: HSA-10, 5 pages.*

Memorandum letter dated May 8, 2006, from U.S. Department of Transportation, Federal Highway Administration, "Information: Cable Barrier Transitions to W-Beam", 2 pages.*

"ATSSA's Roadway Safety Program: Economic Impact of $3.0 billion Annual Safety Initiative." American Economics Group, Inc., Washington, DC. Nov. 2002. pp. 1-33.

Letter from John R. Baxter, Director of Office of Safety for the US Department of Transportation, Federal Highway Administration to Rick Mauer. Oct. 19, 2005.

Letter from John R. Baxter, Director of Office of Safety for the US Department of Transportation, Federal Highway Administration to Rodney A. Boyd. Jun. 8, 2004.

Letter from John R. Baxter, Director of Office of Safety for the US Department of Transportation, Federal Highway Administration to Jerry Emerson, P.E. Oct. 4, 2005.

Memorandum from John R. Baxter, Director of Office of Safety USDT regarding Cable Barrier Transitions to W-Beam Guardrail. May 8, 2006.

"Metal Beam Guard Fence Transition (TL2)." Low Speed Transition. Texas Department of Transportation Design Division.

"Metal Beam Guard Fence Transition (T101)." For T101 Bridge Rail. Texas Department of Transportation Design Division.

* cited by examiner

HIGH TENSION CABLE TO METAL BEAM GUIDE FENCE TRANSITION

PRIORITY CLAIMS

This application claims the benefit of priority to U.S. Provisional Application No. 60/676,926, filed on May 2, 2005, entitled "HIGH TENSION CABLE TO W-BEAM TRANSITION", invented by John Williams, which is hereby incorporated by reference in its entirety.

This application also claims the benefit of priority to U.S. Provisional Application No. 60/718,886, filed on Nov. 17, 2005, entitled "HTCB-MBGF TRANSITION", invented by John Williams, which is hereby incorporated by reference in its entirety.

FIELD OF THE INVENTION

The present invention relates to the field of protecting vehicles from roadside hazards, and more particularly to an apparatus for providing a transition from a High Tension Cable Barrier to a Metal Beam Guide Fence.

DESCRIPTION OF THE RELATED ART

A Metal Beam Guide Fence attached to a bridge abutment is designed to prevent a collision between a vehicle and the bridge abutment. A vehicle exiting a driving lane near the bridge abutment may first contact the Metal Beam Guide Fence. The Metal Beam Guide Fence then absorbs at least a portion of the energy of the impact of the vehicle and/or redirects the vehicle past the bridge abutment and back into the driving lane. In some accidents, the vehicle may impact the end of the Metal Beam Guide Fence and extensively damage the vehicle and the people within the vehicle may be injured. In other accidents, the vehicle may pass behind the Metal Beam Guide Fence with other possibly severe consequences.

Low tension cable barriers have been positioned prior to Metal Beam Guide Fences in an attempt to prevent vehicles from impacting the end of the Metal Beam Guide Fence. The deflections of the low tension cable barriers are large and allowed for a more gentle ridedown in areas where larger deflections can be accommodated.

A High Tension Cable Barrier is typically installed in a median between driving lanes to prevent vehicles from crossing the median and colliding with other oncoming vehicles. A High Tension Cable Barrier is typically not used at a bridge abutment, however, because the deflection of the High Tension Cable Barrier by an impacting vehicle may be too large and may allow the vehicle to impact off-road obstructions. In these areas, Metal Beam Guide Fence is commonly used.

An apparatus is desired that could be used in addition to the Metal Beam Guide Fence that would extend the protection to vehicles exiting a driving lane.

SUMMARY OF THE INVENTION

The present invention comprises a transition device attached to a modified guardrail section of a Metal Beam Guide Fence for transferring a collision load from a High Tension Cable Barrier to the Metal Beam Guide Fence. The Metal Beam Guide Fence may be attached to a roadside hazard, such as a bridge abutment. A vehicle exiting a driving lane near the roadside hazard may first contact and deflect the cables of the High Tension Cable Barrier. The High Tension Cable Barrier may redirect the vehicle away from the end of the Metal Beam Guide Fence and may transfer the vehicle and the collision load to other portions of the Metal Beam Guide Fence. A transition device attached to the Metal Beam Guide Fence may interact with the high-tension cables of the High Tension Cable Barrier to transfer the impact tension of the high-tension cables to the Metal Beam Guide Fence. In this manner, the combination of a High Tension Cable Barrier interacting with a Metal Beam Guide Fence may not only prevent a collision between the vehicle and an off-road obstruction, but may also prevent a collision between the vehicle and the end portion of the Metal Beam Guide Fence, and may prevent the vehicle from passing behind the Metal Beam Guide Fence.

In some embodiments of the present invention, the High Tension Cable Barrier may be in-line with a portion of the Metal Beam Guide Fence that is situated in front of an off-road obstruction. In other embodiments of the present invention, the High Tension Cable Barrier may be offset from the portion of the Metal Beam Guide Fence that is situated in front of an off-road obstruction, and instead interacts with an angled portion of the Metal Beam Guide Fence.

In some embodiments, the transition device comprises a plate and one or more tubes. Each of the one or more tubes may be attached to the plate. In other embodiments, the transition device further comprises one or more support members. Each of the one or more support members may be positioned between a corresponding tube and the plate and may be attached to both the corresponding tube and the plate. The attachment method may be welding.

The transition device may be attached to the modified guardrail section by bolts or other fasteners. The transition device may also be attached to the modified guardrail section by welding.

The plate may be formed into a shape to conform to the shape of a modified guardrail section such as the shape of a W-beam panel. The shape of the plate may allow the transition device to nest against the modified guardrail section. The plate may have attachment holes for bolting to the modified guardrail section and cable slots to allow passage of cables through the plate.

The inner diameter of the tubes may be selected to enable one or more cables of the High Tension Cable Barrier to be inserted through the tubes. The tubes may be modified with an angled cut so that the ends of cables passing through the tubes may be angled away from the modified guardrail section. The angled cut of each of the tubes may also increase the strength of the attachment of each tube to the plate. The support members may also be attached to the tubes and the plate.

In another embodiment, the transition device may be attached to an angled end of a guardrail section.

BRIEF DESCRIPTION OF THE DRAWINGS

A better understanding of the present invention can be obtained when the following detailed description of the preferred embodiment is considered in conjunction with the following drawings, in which.

Figure 1A:
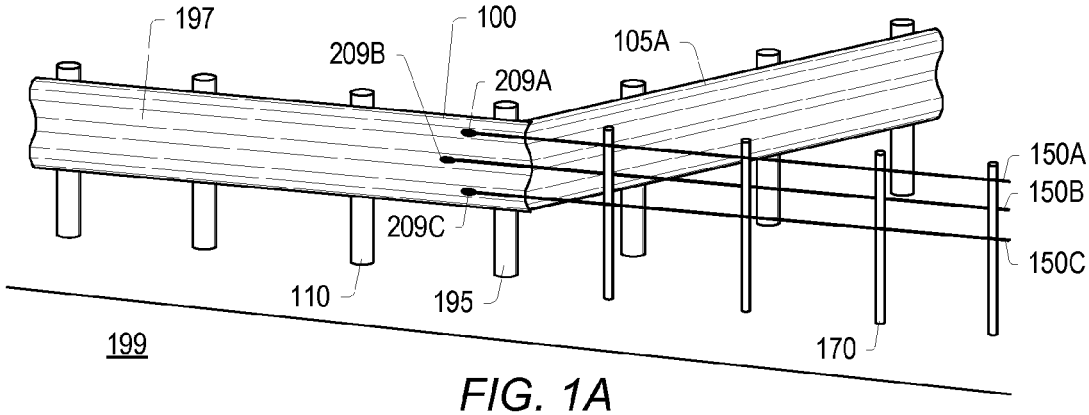
FIG. 1A is a perspective illustration of a set of embodiments of an in-line transition of a High Tension Cable Barrier to a Metal Beam Guide Fence.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

A High Tension Cable Barrier Coupled to a Metal Beam Guide Fence

Figure 2A:
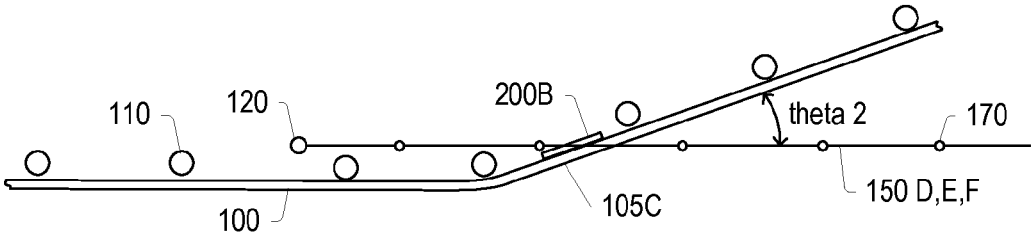
FIG. 2A is an overhead view of an embodiment of a transition of a High Tension Cable Barrier to a Metal Beam Guide Fence where the transition is offset.
Figure 2B:
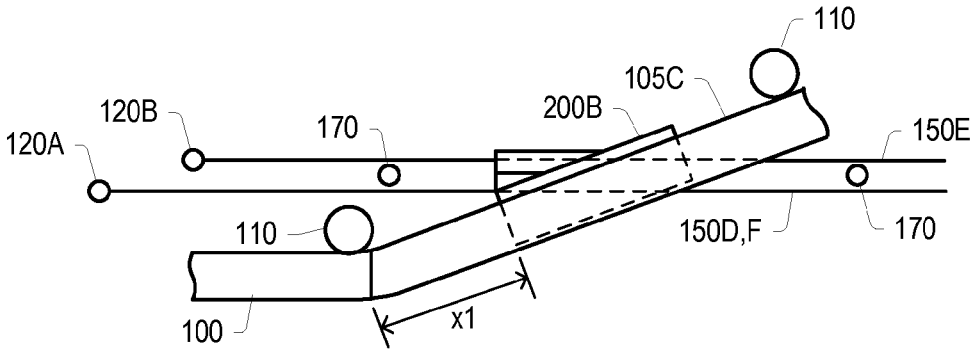
FIG. 2B is a more detailed illustration of the offset transition portion of the High Tension Cable Barrier to the Metal Beam Guide Fence shown in FIG. 2A.
Figure 2C:
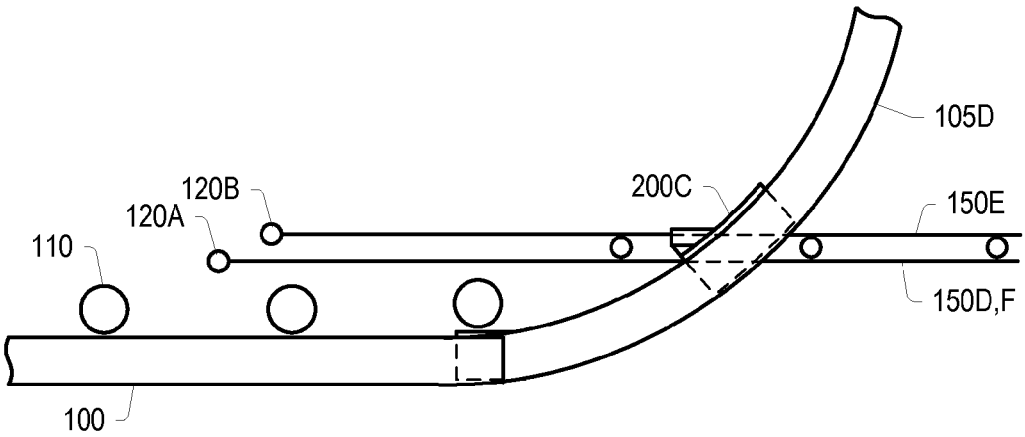
FIG. 2C is an overhead view of another embodiment of the transition of a High Tension Cable Barrier to the Metal Beam Guide Fence where the transition is offset.
Figure 3A:
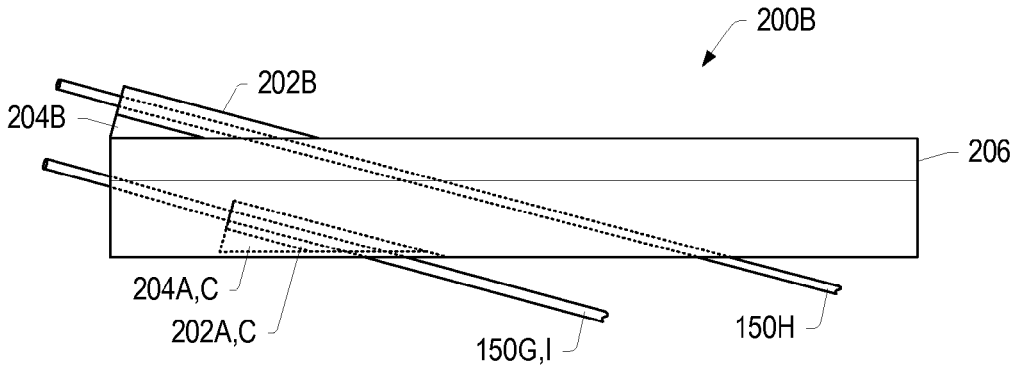
FIG. 3A is an illustration of an embodiment of a transition device 200B for transferring a tension load from a High Tension Cable Barrier to a Metal Beam Guide Fence.
Figure 3B:
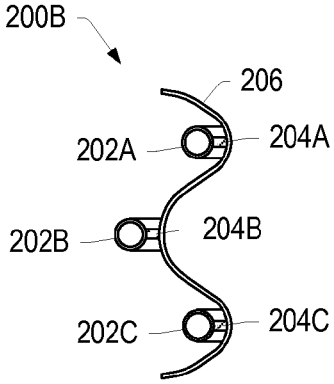
FIG. 3B is an end view of transition device 200B.
Figure 3C:
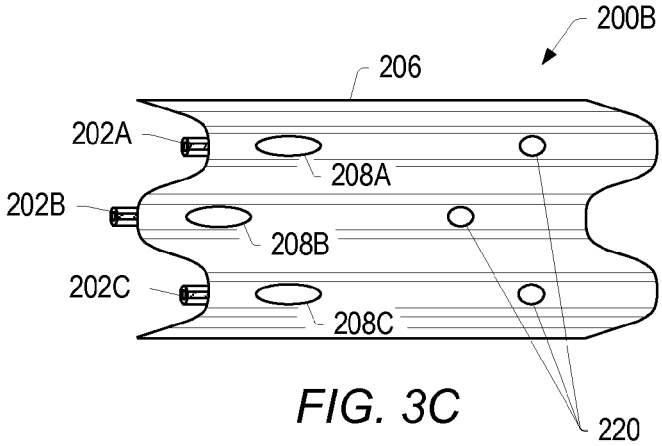
FIG. 3C is a perspective view of transition device 200B.

In some embodiments, a High Tension Cable Barrier may be coupled to a Metal Beam Guide Fence, which may be substantially parallel to an adjacent road 199 and include a guardrail panel 197 supported by posts (e.g., support post 195), as shown in FIG. 1A. FIGS. 1A-2C show various views of a set of embodiments of a transition device 200A attached to a modified guardrail section 100, of the Metal Beam Guide Fence that may transfer an impact tension load from cables 150A-F of the High Tension Cable Barrier to the Metal Beam Guide Fence. FIGS. 3A-C show various views of a transition device 200C. A typical installation of a High Tension Cable Barrier may have three cables (e.g., cables 150A-C, 150D-F, 150G-I, or 150J-L), however, a number of cables other than three is possible and contemplated.

FIG. 1A is a perspective illustration of a set of embodiments of an in-line transition of a High Tension Cable Barrier to a Metal Beam Guide Fence. FIG. 1A shows the cables 150A-C passing through slots 209A-C of a modified guardrail section 100 of the Metal Beam Guide Fence. One example of a modified guardrail section 100 may be a W-beam panel modified with cable slots (such as slots 209A-C) and mounting holes (not shown in FIG. 1A) for attaching the transition device 200A. The transition device 200A may be attached to the modified guardrail section 100 by bolts or other fasteners. In some embodiments, the transition device 200 may also be attached to the modified guardrail section 100 by welding 500. The Metal Beam Guide Fence may be attached to a roadside hazard such as a bridge abutment (not shown in FIG. 1A) that would be located at the left side of FIG. 1A. W-beam panels are produced in a variety of lengths, and any length may be selected for modification as modified guardrail section 100.

A vehicle exiting a driving lane near the bridge abutment may first collide with the tensioned cables 150A-C of the High Tension Cable Barrier. The High Tension Cable Barrier may then reduce the vehicle's speed and may transfer the impact tension load in the cables to the Metal Beam Guide Fence. In this manner, the combination of a High Tension Cable Barrier interacting with a Metal Beam Guide Fence may reduce the severity of a collision between the vehicle and a bridge abutment, but may also prevent the vehicle from passing behind the Metal Beam Guide Fence.

The High Tension Cable Barrier may utilize three 3×7 steel cables 150A-C with static tension of up to 5,600 lbs. (25 KN). The cables 150A-C of the High Tension Cable Barrier may be anchored at one or both ends into end terminals that may be restrained by end terminal posts (such as the end terminal post 120 as shown in FIG. 2A, or 120A,B as shown in FIGS. 2B,C). Each of the three cables may be separately terminated at an end terminal post or a plurality of cables may be terminated at one end terminal post.

Figure 1B:
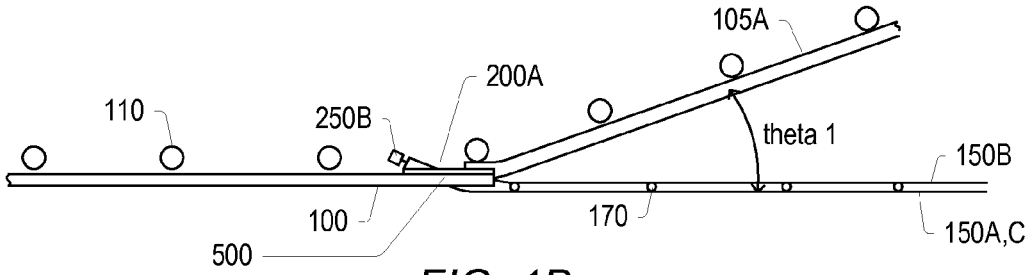
FIG. 1B is an overhead view of the in-line transition of a High Tension Cable Barrier to a Metal Beam Guide Fence shown in FIG. 1A.

FIG. 1B is an overhead view of the in-line transition of a High Tension Cable Barrier to a Metal Beam Guide Fence as shown in FIG. 1A. FIG. 1B shows a transition device 200A attached to the back of the modified guardrail section 100 of the Metal Beam Guide Fence. In some embodiments, the transition device 200A may be attached to the modified guardrail section 100 by bolts or other fasteners. In other embodiments, the transition device 200 may be attached to the modified guardrail section 100 by welding 500. The cables 150A-C pass through the modified guardrail section 100 and the transition device 200A and in some embodiments may be terminated in a cable end termination 250B. Cables 150A,C may also have end terminations (not shown in FIG. 1B since they are primarily hidden by the formed edges of the modified guardrail section 100 in this view). The static tension in cable 150B may press the cable end termination 250B tight against portion 210B of the transition device 200A. Similarly the end terminations for cables 150A,C may also be pressed tight against the transition device 200A. Guardrail section 105A may overlap the modified guardrail section 100. The portion of guardrail section 105A that does overlap may be a straight section or a formed section.

Figure 1C:
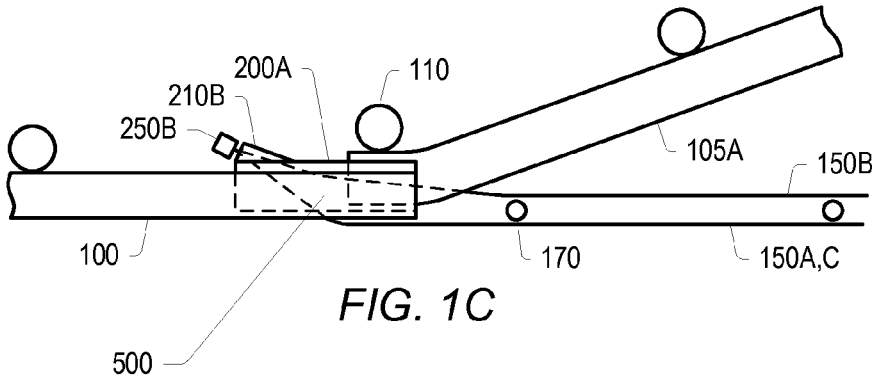
FIG. 1C is a more detailed illustration of the in-line transition portion of the High Tension Cable Barrier to the Metal Beam Guide Fence shown in FIG. 1B.

FIG. 1C is a more detailed illustration of the in-line transition portion of the High Tension Cable Barrier to a Metal Beam Guide Fence shown in FIG. 1B. Guardrail section 105A may also be a curved section (such as section 105D, as shown in FIG. 2C).

FIG. 2A is an overhead view of a set of embodiments of a transition of a High Tension Cable Barrier to a Metal Beam Guide Fence in which the High Tension Cable Barrier is not in-line with the Metal Beam Guide Fence. In these embodiments, the High Tension Cable Barrier may be offset and the cables 150D-F may couple to the angled portion of the Metal Beam Guide Fence. Each of the cables 150D-F of the High Tension Cable Barrier may pass through a modified guardrail section 105C and an attached transition device 200B and then be anchored into an end terminal (such as end terminal 250B) restrained by an end terminal post 120. In these embodiments, tension in the cables may transfer to the modified guardrail section 105C due to forces on the attached transition device 200B from the cables 150D-F. In this manner, an impact by a vehicle against the cables of the High Tension Cable Barrier may transfer a force load to the Metal Beam Guide Fence.

The angle "theta 2" may be selected so that the end of the Metal Beam Guide Fence may be separated from the High Tension Cable Barrier by approximately 4' 6" or more. This separation may avoid a vehicle contacting the end of the Metal Beam Guide Fence as a result of deflections of the High Tension Cable Barrier.

FIG. 2B is a more detailed illustration of the offset transition portion of the High Tension Cable Barrier to a Metal Beam Guide Fence shown in FIG. 2A. Cable 150D and 150F may terminate at the end terminal post 120A. Cable 150E may terminate at the end terminal post 120B. Cable 150F may also terminate at a separate end terminal post (not shown in FIG. 2B). In these embodiments, the distance "x1" may define the amount of offset of the High Tension Cable Barrier. The amount of offset may be defined as the distance between the position the cables 150D-F may couple to the angled portion of the Metal Beam Guide Fence and the bend in the Metal Beam Guide Fence.

FIG. 2C is an overhead view of another embodiment of an offset transition of a High Tension Cable Barrier to a Metal Beam Guide Fence. In this embodiment, the modified guardrail section 105D is shown as a curved section. A transition device 200C may be similarly curved to match the radius of the curve of modified guardrail section 105D in such an embodiment.

Transition Device

FIGS. 3A-C show various views of an embodiment of a transition device 200B that may be effective in transferring an impact tension load in high tension cables from a High Tension Cable Barrier to a Metal Beam Guide Fence. FIG. 3A shows an edge view of the transition device 200B comprising a plate 206 and one or more tubes 202A-C. The one or more tubes 202A-C may be attached to the plate 206. In some embodiments, transition device 200B may further comprise one or more support members 204A-C. In these embodiments, the one or more tubes 202A-C may be attached to both a corresponding support member and the plate 206. The attachment method may be welding. However, a variety of other attachment methods may be used as well.

The plate 206 (also referred to as a nesting plate) may be a sheet of 3⁄16 inch thick steel, although other materials and thicknesses are contemplated. The plate 206 may be formed into a shape to conform to the shape of a modified guardrail section 100. The shape of plate 206 may be the shape of a W-beam panel as shown in FIG. 3B (an end view of transition device 200B). The shape of plate 206 may allow transition device 200B to nest against the modified guardrail section 100. In some embodiments, the transition device 200B may be attached to the modified guardrail section 100 by bolts or other fasteners. In other embodiments, the transition device 200B may be attached to the modified guardrail section 100 by welding. The plate 206 may have mounting holes 220 for bolting to the modified guardrail section 100 and cable slots 208A-C as shown in FIG. 3C.

The tubes 202A-C may be modified sections of steel pipe. The ID of the pipe may be selected to enable a high tension cable of the High Tension Cable Barrier to be inserted through the tubes 202A-C. A 1" OD steel pipe may be selected. Tubes of other materials and dimensions are contemplated. The tubes 202A-C may be modified with an angled cut from the center of one end to the side of each of the tubes 202A-C as shown in FIG. 3A. The angled cut may enable the tubes to be welded to the plate along the outside edge of the angled cut to increase the strength of the attachment of the tube to the plate 206. In some embodiments, the angle of the cut may be selected so that the surface of the tube at the angled cut may contact the plate 206 when the tube is supported by a corresponding one of the support members 204A-C. Each of the tubes 202A-C may also be welded to a corresponding one of the support members 204A-C in the configuration shown in FIGS. 3A-B.

The support members 204A-C (also referred to as gusset plates) may be ¼ inch thick steel plate. In some embodiments, the support members 204A-C may be made from U shaped channels. The support members 204A-C may be welded to the plate 206 and the tubes 202A-C.

Figure 4:
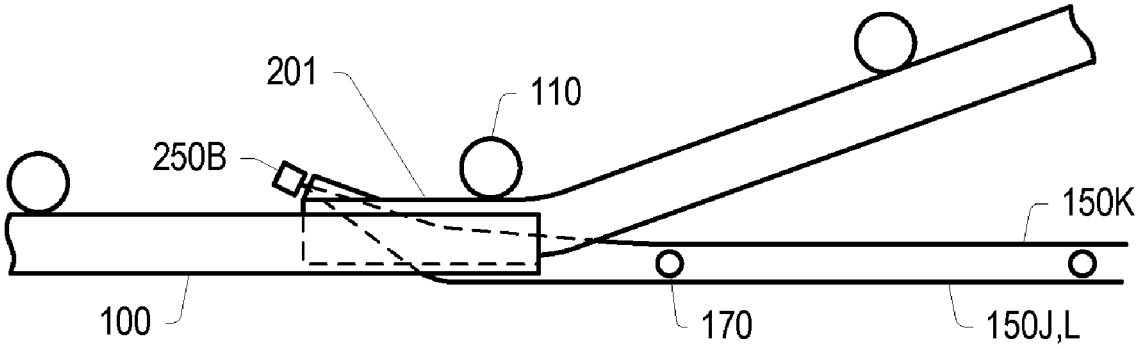
FIG. 4 is another embodiment of a transition device 201 for an in-line transition of a High Tension Cable Barrier to a Metal Beam Guide Fence.

FIG. 4 shows another embodiment of a transition device 201 that may enable transfer of impact tension from cables of a High Tension Cable Barrier to a Metal Beam Guide Fence. In this embodiment, the transition device 201 may be fabricated by attaching transition device 200A to a first end of a modified guardrail section. The guardrail section is modified with an angled cut at the first end. The angle of the cut is selected to provide a specified angle between the transition device 200A and the modified guardrail section. In an alternate embodiment, transition device 200A is also modified with an angled cut at the attaching end, and the angle of each cut is selected to provide a specified angle between the transition device 200A and the modified guardrail section. The method of attachment may be by welding, however, other methods are possible and contemplated.

In still another embodiment of a transition device 201, plate 206 may be replaced by a modified guardrail section with a formed end portion and one or more tubes and corresponding support members attached to the formed end portion. The formed end may have a length equivalent to the length of the plate 206. The guardrail section may be modified with cable slots and attachment holes to bolt transition device 201 to a modified guardrail section 100. Guardrail section 100 may be modified with cable slots and attachment holes.

Although the embodiments above have been described in considerable detail, numerous variations and modifications will become apparent to those skilled in the art once the above disclosure is fully appreciated. It is intended that the following claims be interpreted to embrace all such variations and modifications.

I claim:

1. An apparatus, comprising:

an assembly comprising a plate, a plurality of tubes, and a guardrail section, wherein the guardrail section comprises a guardrail panel supported by at least one support post; and a plurality of tensioned cables of a high tension cable barrier;

wherein the plurality of tubes are attached to the plate; and wherein the plate is attached to the guardrail panel; and wherein the plurality of tensioned cables of the high tension cable barrier pass through aligned openings in the plate and the guardrail panel of the assembly;

wherein each of the plurality of tubes attached to the plate respectively receiving the plurality of tensioned cables; and wherein the assembly is configured to receive at least part of a tension load of the plurality of tensioned cables.

2. The apparatus of claim 1, wherein the plurality of tensioned cables are anchored against the assembly with cable end terminals.

3. The apparatus of claim 2, wherein each of two or more tubes of the plurality of tubes is attached to the plate through welding.

4. The apparatus of claim 1, wherein the plurality of tensioned cables comprises three steel cables tensioned up to approximately 5,600 lbs.

5. The apparatus of claim 1, further comprising a plurality of gusset plates, wherein each of two or more of the plurality of gusset plates is positioned between a corresponding one of the plurality of tubes and the plate, and wherein the plurality of gusset plates are attached to the plurality of tubes and the plate.

6. The apparatus of claim 1, wherein the plate is substantially parallel to the guardrail panel in the assembly.

7. The apparatus of claim 1, wherein the plate is a steel plate.

* * * * *